US007903985B2

(12) United States Patent
Yang

(10) Patent No.: US 7,903,985 B2
(45) Date of Patent: Mar. 8, 2011

(54) IMAGE FORMING SYSTEM HAVING WET AND DRY IMAGING PARTS

(75) Inventor: Cheol-soo Yang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 78 days.

(21) Appl. No.: 12/427,002

(22) Filed: Apr. 21, 2009

(65) Prior Publication Data

US 2010/0061739 A1 Mar. 11, 2010

(30) Foreign Application Priority Data

Sep. 9, 2008 (KR) ..... 2008-88836

(51) Int. Cl.
*G03G 15/00* (2006.01)
*G03G 15/01* (2006.01)

(52) U.S. Cl. ..... 399/2; 347/2; 399/110

(58) Field of Classification Search ..... 399/2, 1, 399/110, 223, 298, 299, 302; 347/2
See application file for complete search history.

(56) References Cited

U.S. PATENT DOCUMENTS 5,321,467 A * 6/1994 Tanaka et al. ..... 399/2
5,570,451 A * 10/1996 Sakaizawa et al. ..... 399/2
5,761,565 A * 6/1998 Baker et al. ..... 399/2
5,781,823 A * 7/1998 Isobe et al. ..... 399/2
5,790,915 A * 8/1998 Arcaro et al. ..... 399/2
6,459,858 B1 * 10/2002 Davis ..... 399/2
7,274,883 B2 * 9/2007 Evans ..... 399/2
7,684,997 B2 * 3/2010 Reichelsheimer ..... 705/1.1
2002/0191978 A1 * 12/2002 Morimoto ..... 399/2
2004/0005155 A1 * 1/2004 Miyazaki ..... 399/2
2008/0019707 A1 * 1/2008 Kamisuwa ..... 399/2
2009/0305154 A1 * 12/2009 Lieberman ..... 399/2 X

FOREIGN PATENT DOCUMENTS

JP 05-301385 A * 11/1993
JP 08-328325 A * 12/1996
JP 09-136452 A * 5/1997
JP 2003-072052 A * 3/2003

* cited by examiner

*Primary Examiner* — Sophia S Chen
(74) *Attorney, Agent, or Firm* — Stanzione & Kim, LLP

(57) ABSTRACT

An image forming system includes a first developing unit to form an image using a dry developer and a second developing unit to form an image using a wet developer. The first developing unit forms an image using yellow, magenta, cyan and black developers, and the second developing unit forms an image using a developer having lighter colors than the yellow, magenta, cyan and black developers. Therefore, light colors requiring high resolution and high definition may be printed using a wet type image forming module capable of easily expressing the light colors, and original and dark colors may be printed using a dry image forming module. Hence, it is possible to print a color image having high resolution and high definition, and enhance the color reproducibility of the image.

29 Claims, 6 Drawing Sheets

IMAGE FORMING SYSTEM HAVING WET AND DRY IMAGING PARTS

CROSS-REFERENCE TO RELATED APPLICATIONS

This application claims priority under 35 U.S.C. §119 (a) from Korean Patent Application No. 10-2008-0088836, filed on Sep. 9, 2008, in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an image forming system to enhance color reproducibility.

2. Description of the Related Art

Various types of color image forming apparatuses have been developed and, in particular, electrophotographic color image forming apparatuses capable of high speed printing have attracted considerable attention recently. Electrophotographic color image forming apparatuses print color images using yellow, magenta, cyan and black developers.

When an electrophotographic color image forming apparatus prints a high-resolution color image such as a photograph, it is difficult to express a full range of colors of the image using only the four color developers.

An electrophotographic image forming apparatus using a digital image signal adjusts the dot density at a predetermined electric potential and forms an electrostatic latent image. However, in this situation, developer particles are not uniformly attached to dots of the electrostatic latent image formed with the predetermined electric potential, and it is difficult for developer particles to be transferred. Additionally, the image gradient corresponding to the dot density ratio of dots to which developer particles are attached to other dots is not high. Furthermore, even when the size of dots is reduced in order to increase the resolution, there is a limit to the degree to which the reproducibility, gradient and sharpness of images can be increased.

In order for the electrophotographic color image forming apparatus to express highlight colors, such as light yellow, light red or light blue, or light colors, the number of dots of an image to be printed needs to be reduced. Accordingly, the color reproducibility of light colors may be reduced, and the image quality, for example, image definition, may also be reduced.

SUMMARY OF THE INVENTION

The present general inventive concept provides an image forming system to print an image with high resolution and high definition, and to enhance color reproducibility.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an image forming system including a first developing unit to form an image using a dry developer, and a second developing unit to form an image using a wet developer, wherein the dry developer used by the first developing unit includes yellow, magenta, cyan and black developers, and the wet developer used by the second developing unit includes a developer having a lighter color than the dry developer used by the first developing unit.

The second developing unit may include an inkjet module detachably or attachably mounted in the image forming system, and may be disposed below the first developing unit based on a direction in which a sheet of paper is conveyed.

The second developing unit may use at least one color developer among light cyan, light magenta, light black, light yellow, white and transparent developers. Additionally, the second developing unit may use at least one liquid developer among a metallic liquid developer, a conductive liquid developer and a liquid developer visible with infrared rays or ultraviolet rays.

The first developing unit may further include a subsidiary developing unit to use color developers other than the yellow, magenta, cyan and black developers, and the second developing unit may use at least one liquid developer among a metallic liquid developer, a conductive liquid developer and a liquid developer visible with infrared rays or ultraviolet rays.

The image forming system may further include a dry unit disposed between the first developing unit and the second developing unit.

The image forming system may further include a fixing unit to fix an image developed by the first developing unit, and the second developing unit may be disposed below the fixing unit.

The first developing unit and the second developing unit may be selectively operated.

The foregoing and/or other features and utilities of the present general inventive concept may also be achieved by providing an image forming system including a first printing apparatus using a dry developer, and a second printing apparatus configured in the form of a module detachably mounted in the image forming system, the second printing apparatus using a wet developer, wherein a first color developer used by the first printing apparatus is different in color from a second color developer used by the second printing apparatus.

The second color developer may be lighter than the first color developer. The printing may be performed using the second printing apparatus and then using the first printing apparatus.

The foregoing and/or other features and utilities of the present general inventive concept may also be achieved by providing an image forming system including a first image forming system comprising a first developing unit to form an image using a dry developer, a second image forming system comprising a second developing unit to form an image using a wet developer, the second image forming system being detachably mounted in the first image forming system, and an interface apparatus to connect the first image forming system to the second image forming system, to enable a signal exchange therebetween.

The first image forming system may be provided separately from the second image forming system, and may be connected to the second image forming system so that a signal may be exchanged therebetween through the interface apparatus.

The interface apparatus may be one of a server and a personal computer (PC) which are connected to the first image forming system and the second image forming system. The interface apparatus may output a control command to print a normal image using the first image forming system after performing light color printing using the second image forming system.

The interface apparatus may include a paper supply unit to convey sheets of paper according to a printing order. The paper supply unit may be provided integrally with one of the first image forming system and the second image forming system, or may be provided separately and connect the first image forming system to the second image forming system.

As described above, light colors requiring high resolution and high definition may be printed using a wet type image forming module capable of easily expressing the light colors, and original and dark colors may be printed using a dry image forming module. Hence, it is possible to print a color image having high resolution and high definition, and enhance the color reproducibility of the image.

Additionally, a print module having a special developer may be provided separately in order to print secure documents or print corporate identification (CI) using the special developer, so it is possible for the image forming systems described above to be utilized in various fields.

The foregoing and/or other features and utilities of the present general inventive concept may also be achieved by providing an image forming system, including a dry developing unit to form a first image on a recording medium, and a wet developing unit to form a second image on the recording medium, the dry developing unit and the wet developing unit being disposed within a housing.

The recording medium may be fed to the dry developing unit before being fed to the wet developing unit. The recording medium may also be fed to the wet developing unit before being fed to the dry developing unit.

The second image may be formed at least one of adjacent to, at an edge of, overlapping, partially overlapping, around, next to, or at a boundary of the first image.

The first image and the second image may be formed on different sides of the recording medium.

The dry developing unit and the wet developing unit may be selectively operated such that only one of the dry developing unit and the wet developing unit form an image on the recording medium.

The first image and the second image may be formed at different resolutions.

The dry developing unit may include at least one of yellow, cyan, magenta, black, light cyan, light magenta, light black, light yellow, white, and a transparent developer.

The wet developing unit may include at least one of a metallic liquid developer, a conductive liquid developer, a liquid developer visible with infrared or ultraviolet light, light cyan, light magenta, light black, light yellow, white, and a transparent developer.

The foregoing and/or other features and utilities of the present general inventive concept may also be achieved by providing a method of forming an image in an image forming apparatus having a wet image forming unit and a dry image forming unit disposed in a housing, the method including feeding a recording medium to at least one of the wet image forming unit and the dry image forming unit to form at least one of a first image and a second image on the recording medium.

The first image may be formed before the second image, and the second image may be formed before the first image.

The second image may be formed at least one of adjacent to, at an edge of, overlapping, partially overlapping, around, next to, or at a boundary of, the first image.

The first image and the second image may be formed on different sides of the recording medium.

The first image and the second image may be formed at different resolutions.

The wet developing unit may perform at least one of definition adjustment, image edge processing, gamut mapping, color enhancing processing, half tone processing, forming a smooth tone, and forming a glossy image on the first image.

BRIEF DESCRIPTION OF THE DRAWINGS

These and/or other features and utilities of the present general inventive concept will become apparent and more readily appreciated from the following description of certain exemplary embodiments, taken in conjunction with the accompanying drawings of which.

DETAILED DESCRIPTION OF THE PREFERRED EMBODIMENTS

Figure 1:
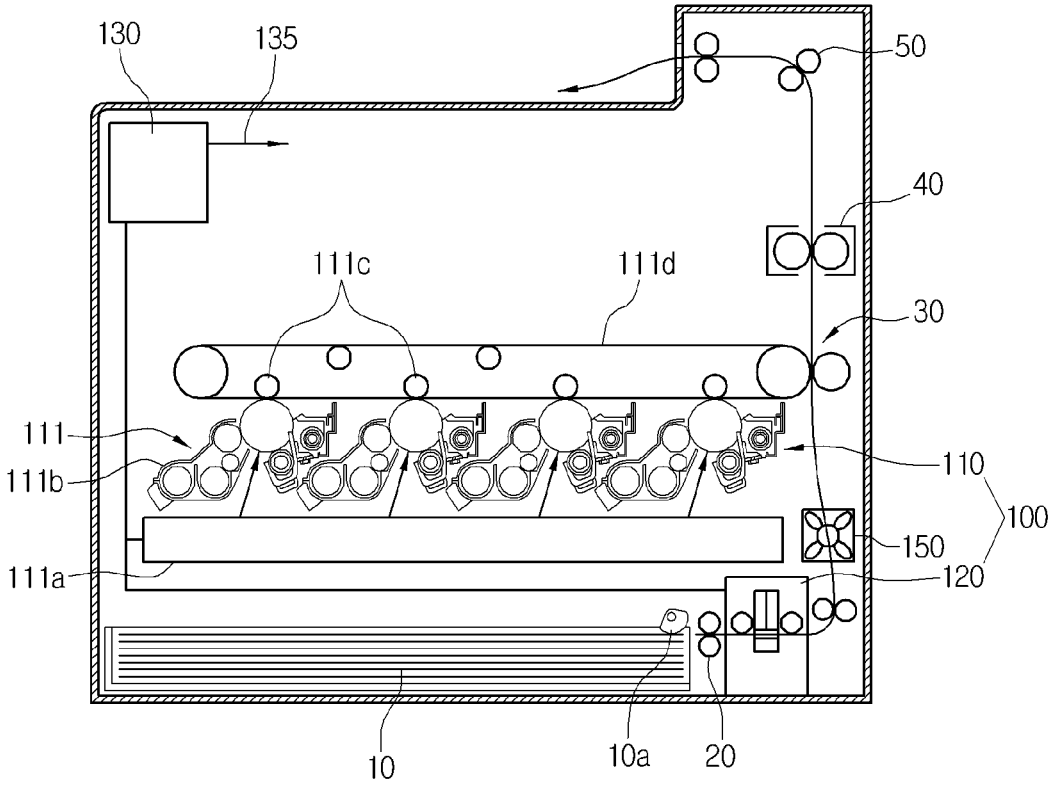
FIG. 1 illustrates an image forming system according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below in order to explain the present general inventive concept by referring to the figures.

Figure 2:
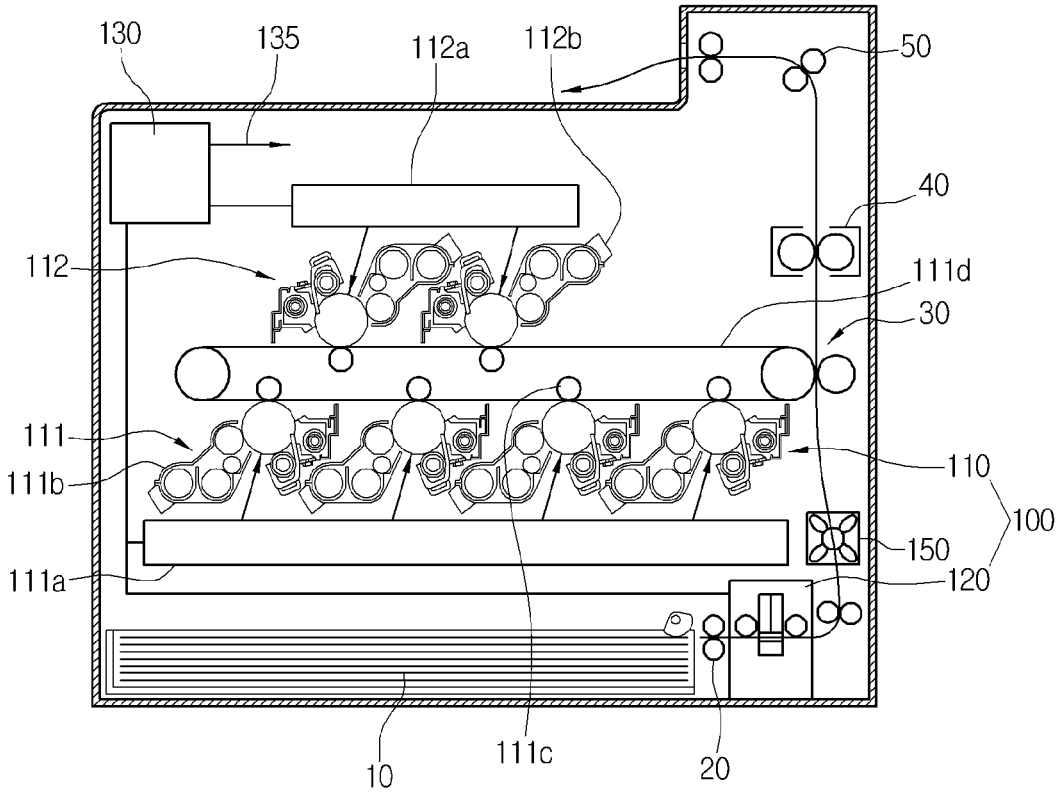
FIG. 2 illustrates an image forming system according to an exemplary embodiment of the present general inventive concept.

FIGS. 1 and 2 illustrate image forming systems according to exemplary embodiments of the present general inventive concept.

Each of the image forming systems illustrated in FIGS. 1 and 2 includes a feeding unit 10, a conveying unit 20, a transferring unit 30, a developing unit 100, a fixing unit 40 and a discharging unit 50. The configurations and operations of the feeding unit 10, conveying unit 20, transferring unit 30, fixing unit 40 and discharging unit 50 are known to those skilled in the art, so no further description thereof is required.

The developing unit 100 includes a first developing unit 110, a second developing unit 120 and a print controller 130. The first developing unit 110 can use four color dry developers, namely yellow, magenta, cyan and black developers, and the second developing unit 120 can be of an inkjet type and can use multiple color liquid developers.

The first developing unit 110 can form a print image using an electrophotographic process with the four color dry developers, and the second developing unit 120 can form a print image using a wet developer such as ink which is typically used in inkjet type developing units.

First developing unit 110 includes an exposure device 111*a*, a plurality of rotating bodies 111*b* including a charging roller, a developing roller, a supply roller, and a photosensitive drum which can be controlled by controller 130 with control signals 135. The charging roller uniformly charges a surface of the photosensitive drum to a predetermined potential. The exposure device 111*a* scans the photosensitive drum with light corresponding to image information which may be conveyed by controller 130 to form an electrostatic latent image on the surface of the photosensitive drum according to potential differences between portions scanned and not scanned. The developing roller forms a toner image by supplying toner supplied by the supply roller onto the electrostatic latent image on the photosensitive drum. The toner image is then transferred by transfer rollers 111*c* from the photosensitive drum to belt 111*d*, which conveys the toner image to transferring unit 30. The toner image is then separated from the belt 113*a* and transferred to a recording medium by transferring unit 30. The fixing device 40 may then apply heat and pressure to the toner image to cause the toner image to be fused and fixed onto the recording medium. First developing unit 110, transferring unit 30 and fixing unit 40 are controlled by the controller 130. Alternatively, a single photosensitive drum may be used in place of belt 111*d* and the plurality of rotating bodies may be configured to provide toner to the photosensitive drum for transfer to the recording medium.

Second developing unit 120 includes a printhead and an ink supply. Second developing unit 120 forms an image by discharging ink droplets from the printhead onto a recording medium. The printhead may have a plurality of nozzles from which ink of the same color or different colors is ejected. The printhead may be, for example, a thermal type or piezoelectric type printhead to discharge the ink droplets. The printhead may also be a shuttle type printhead or an array type printhead. The positioning of the printhead and the discharge of ink is controlled by controller 130. A recording medium is picked up by pickup roller 10*a* of the feeding unit 10 and conveyed to the second developing unit 120 by the conveying unit 20, which may include rollers to convey the sheet of paper.

The wet developer used by the second developing unit 120 can be mixed with various colors more easily than the dry developers, and thus it is possible to more finely express light colors. Hereinafter, an inkjet type developing unit using a wet developer will be described in the present general inventive concept, but this is not intended as a limitation thereto. Accordingly, the present general inventive concept is also applicable to any wet type print module.

The print controller 130 is connected to the first developing unit 110 and the second developing unit 120, as illustrated in FIGS. 1 and 2, to control printing operations. More specifically, the print controller 130 controls the first developing unit 110 and the second developing unit 120 to set a printing order for the colors used, and to adjust the print resolution. The print controller 130 may also control the feeding unit 10, conveying unit 20, transferring unit 30, fixing unit 40 and discharging unit 50 through control signals 135.

According to the exemplary embodiment as illustrated in FIG. 1, the second developing unit 120 is disposed below the first developing unit 110 so that a sheet of paper is conveyed to the first developing unit 110. Accordingly, the second developing unit 120 develops a first color image on the sheet of paper picked up by the feeding unit 10. The sheet of paper on which the color image is formed by the second developing unit 120 is then transferred to the first developing unit 110, and the first developing unit 110 develops a second color image using the dry developers stored therein. In this example, the second developing unit 120 contains light color liquid developer such as light cyan, light magenta, light black, light yellow, or white liquid developer, to print light colors on sheets of paper.

Accordingly, the second developing unit 120 may print highlight colors and light colors which the first developing unit 110 has difficulty expressing using the dry developers, so it is possible to obtain color prints with superior color reproducibility and high definition.

According to the exemplary embodiment as illustrated in FIG. 2, the first developing unit 110 may include a main developing unit 111 which can use yellow, magenta, cyan and black developers, and a subsidiary developing unit 112 which can use a light color developer, such as light cyan, light magenta, light black, or light yellow developer for printing light colors, a transparent developer, and a white developer. Main developing unit 111 may include exposure device 111*a* and a plurality of rotating bodies 111*b* similar to those described with respect to FIG. 1. Subsidiary developing unit 112 may include exposure device 112*a* and a plurality of rollers 112*b* similar to the main developing unit 111 similar to those described above. Toner may be transferred to belt 111*d* from main developing unit 111 and subsidiary developing unit 112, and may be conveyed to transferring unit 30 for transfer to a recording medium, as described above with respect to FIG. 1.

Use of a light color developer, such as a light cyan developer or light magenta developer contained in the subsidiary developing unit 112, enables the number of dots to be increased more than in a conventional image forming apparatus, and thus increases the image quality. Additionally, use of the transparent developer enables the difference of the thickness of portions of an image formed using dry developers to be compensated for so as to increase the glossiness of the printed image, such that a color image with greater image quality can be obtained. Furthermore, the use of the transparent developer can produce effects similar to glossy paper, and thus an image formed using a combination of the liquid developer of the inkjet type second developing unit 120 and the dry developers of the first developing unit 110 can be glossy.

The second developing unit 120 may also use a metallic liquid developer such as a gold liquid developer, silver liquid developer or bronze liquid developer, a conductive liquid developer, or a special liquid developer visible only in a specialized environment such as one using infrared rays or ultraviolet rays. It is therefore possible to print unique color prints, such as, for example, a corporate identification (CI) containing gold, silver, or bronze, which are impossible to print using a general developer without such special developers, or to print an image using a conductive liquid developer, or a special liquid developer which are to be used for secure documents. Accordingly, it is possible to print a testimonial or secure document which a conventional image forming apparatus is not able to print, and thus the image forming system of FIG. 2 can be utilized in a greater number of fields and applications than a conventional image forming apparatus.

The image formed by second developing unit 120 may vary. For example, the image may be on an entire area of a sheet of paper. Alternatively, the image may be formed in a partial area of a sheet of paper, or in a margin of a sheet of paper, or in a boundary area. In addition, the image formed by second developing unit 120 may overlap with the image formed by first developing unit 110. The image may also be formed adjacent to or at an edge of the image formed by first developing unit 110. Furthermore, the images formed by the first developing unit 110 and the second developing unit 120 may be on the same side of a recording medium, or they may be on different sides of a recording medium. The image is formed by the second developing unit according to the controller 130.

Additionally, in order to print a small special mark, it is desirable to operate an inkjet type developing unit rather than using an electrophotographic developing unit, as it is inefficient to operate the electrophotographic developing unit. Accordingly, the second developing unit may be selectively operated such that only the second developing unit forms a small special mark.

In the exemplary embodiments illustrated in FIGS. 1 and 2, each of the image forming systems may further include a dry unit 150 disposed between the inkjet type second developing unit 120 and the first developing unit 110 employing the electrophotographic process. This is to enable ink on a sheet of paper printed through the second developing unit 120 to be dried to a predetermined level of dryness, so that the sheet of paper enters the first developing unit 110 to print an image onto the sheet of paper normally without any contamination of the image. The dry unit 150 may have a structure which those skilled in the art can implement, for example a structure in which heat generated inside an image forming apparatus is used or a fan structure in which wind is used. Accordingly, the dry unit 150 may be implemented as an air cooler to blow in and out, as illustrated in FIGS. 1 and 2, a water cooler, or a structure protecting against heat, such as protection against heat plates or pins, although such a configuration is not illustrated.

If the drying efficiency of the dry unit 150 is high, the solvent content of developer used in the second developing unit 120 may be adjusted to increase the image quality. If the solvent content is reduced, it is possible to fabricate ink having colors which are able to maintain superior color reproducibility and image tone. A solvent is typically an additive used to dry ink on an image, but it has a negative influence on the image quality. Accordingly, when the dry unit 150 has excellent drying efficiency, a developer having superior color reproducibility and image tone may be formulated by reducing the solvent content.

Figure 3:
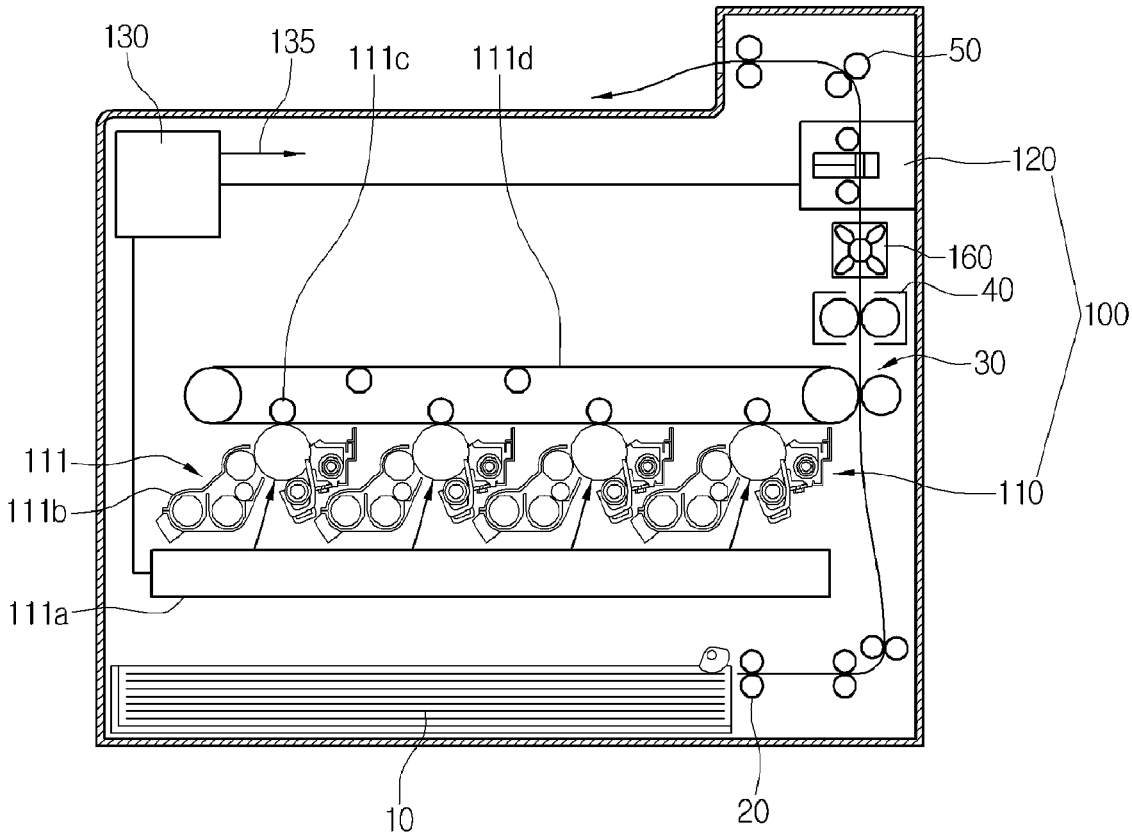
FIG. 3 illustrates an image forming system according to an exemplary embodiment of the present general inventive concept.
Figure 4:
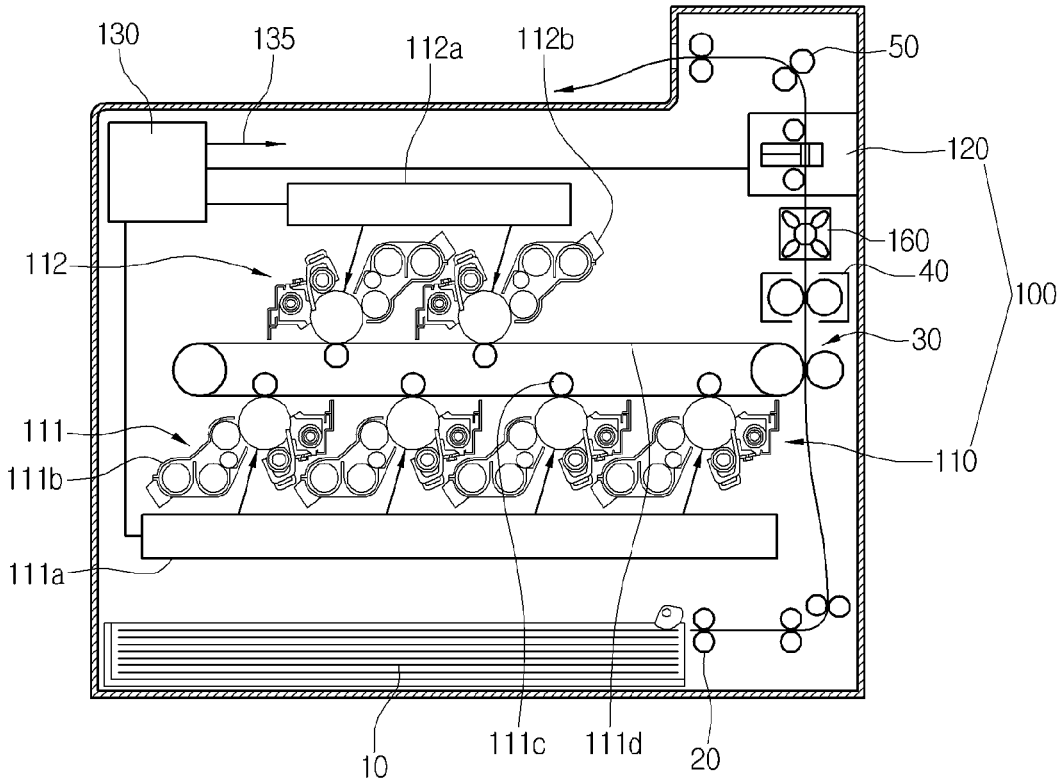
FIG. 4 illustrates an image forming system according to an exemplary embodiment of the present general inventive concept.

FIGS. 3 and 4 illustrate image forming systems according to additional exemplary embodiments of the present general inventive concept.

As illustrated in FIG. 3, the second developing unit 120 is disposed above the first developing unit 110 and the fixing unit 40, so that a color image developed a first by the first developing unit 110 may be developed a second time by the second developing unit 120 using a wet developer. The first and second developing units of FIG. 3 can may have similar structures to those illustrated in FIGS. 1 and 2. Main developing unit 111 may include exposure device 111*a* and a plurality of rotating bodies 111*b* similar to those described above. Toner may be transferred to belt 111*d* from main developing unit 111 and subsidiary developing unit 112, and may be conveyed to transferring unit 30 for transfer to a recording medium, as described above. Operations may be controlled by controller 130 through control signals 135.

In this example, because heat generated by the fixing unit 40 has a negative influence on the second developing unit 120, the image forming system of FIG. 3 may further include a cooling unit 160 to prevent the heat generated by the fixing unit 40 from being transferred to the second developing unit 120. However, the image forming system of FIG. 3 also includes a fan unit (not illustrated) required to create airflow to remove heat generated by the fixing unit 40, so the fan unit may be used instead of the cooling unit 160.

The second developing unit 120 may contain a light color liquid developer, such as a light cyan liquid developer or a light magenta liquid developer, in the same manner as in the exemplary embodiment illustrated in FIG. 1. Accordingly, if the first developing unit 110 develops dark colors using the dry developers, the fixing unit 40 may fuse the image onto a sheet of paper using heat and pressure, and the second developing unit 120 may then develop highlight colors and light colors which the first developing unit 110 has difficulty expressing using the dry developers, so that the highlight colors and light colors may be superimposed over the fused image, thereby finishing the printing operation.

According to another exemplary embodiment as illustrated in FIG. 4, the second developing unit 120 is also disposed above the first developing unit 110 and the fixing unit 40 in the same manner as the exemplary embodiment illustrated in FIG. 3. However, as illustrated in FIG. 4, the first developing unit 110 may perform full color printing, that is not only light color printing but also dark color printing, and the second developing unit 120 may then perform special printing using a special liquid developer. The first and second developing units of FIG. 4 can have similar structures to those illustrated in FIGS. 1 and 2.

The first developing unit 110 may include a main developing unit 111 to use yellow, magenta, cyan and black developers, and a subsidiary developing unit 112 to use a light color developer, such as a light cyan developer or a light magenta developer, and a transparent developer. Accordingly, the first developing unit 110 employing the electrophotographic process may perform both dark color printing and light color printing, and may compensate for the difference in thickness of portions of an image using the transparent developer. Main developing unit 111 may include exposure device 111*a* and a plurality of rotating bodies 111*b* similar to those described above. Subsidiary developing unit 112 may include exposure device 112*a* and a plurality of rollers 112*b* similar to the main developing unit 111. Toner may be transferred to belt 111*d* from main developing unit 111 and subsidiary developing unit 112, and may be conveyed to transferring unit 30 for transfer to a recording medium, as described above. Operations may be controlled by controller 130 through control signals 135.

The second developing unit 120 may use a metallic liquid developer, such as a gold liquid developer, silver liquid developer or bronze liquid developer, a conductive liquid developer, or a special liquid developer visible only in a specialized environment such as one using infrared rays or ultraviolet rays. It is therefore possible to print unique color prints, such as, for example, a corporate identification (CI) containing gold, silver or bronze, which are impossible to print using a general developer without such special developers, or to obtain prints using the special liquid developer which is able to be applied to a secure document to be identified only in a specialized environment.

The first developing unit 110 and the second developing unit 120 may be selectively operated. For example, in the exemplary embodiments illustrated in FIGS. 1 and 3, the first developing unit 110 may print a color image using the yellow, magenta, cyan and black developers, and the second developing unit 120 may print light colors using the light cyan developer and light magenta developer. In such case, if a user does not require a high-resolution image, only the first developing unit 110 may be used to form a color image, and there is no need to use the second developing unit 120.

Additionally, in the exemplary embodiments illustrated in FIGS. 2 and 4, the first developing unit 110 may print not only light colors but also dark colors, and the second developing unit 120 may print metallic colors such as gold, or perform printing using a special liquid developer. In this case, if a user requires only special printing, only the second developing unit 120 may be operated to print a special image without the need to use the first developing unit 110. Alternatively, only the first developing unit 110 may be used to print a color image.

The first developing unit 110 and the second developing unit 120 may have different resolutions, measured, for example, using dots per inch (DPI). Light color printing performed by the inkjet type second developing unit 120 can include subsidiary operations to support the first developing unit 110, for example processing an image formed by the first developing unit 110 to have a smooth tone, or making the image glossy, and accordingly there is no need for the second developing unit 120 to have a high resolution. For example, if the first developing unit 110 has a resolution of about 600 DPI, the second developing unit 120 may have a resolution of about 150 DPI or about 300 DPI, in order to reduce the CPU processing load for data processing.

Alternatively, the second developing unit 120 may have a high resolution. For example, if a user desires to print a high-resolution image, such as a photograph, the second developing unit 120 equipped with an inkjet module may need to have a high resolution. More specifically, the first developing unit 110 using dry developers may express basic colors, namely dark colors, for example, of a photograph, and the second developing unit 120 equipped with the inkjet module may perform more precise processing on the image, such as definition adjustment, image edge processing, gamut mapping, color enhancing processing or half tone processing. The second developing unit 120 equipped with the inkjet module may form an image with a high resolution of about 1200 DPI, about 2400 DPI or about 4800 DPI. The first developing unit 110 using the dry developers may form an image with a resolution of about 600 DPI.

Figure 5:
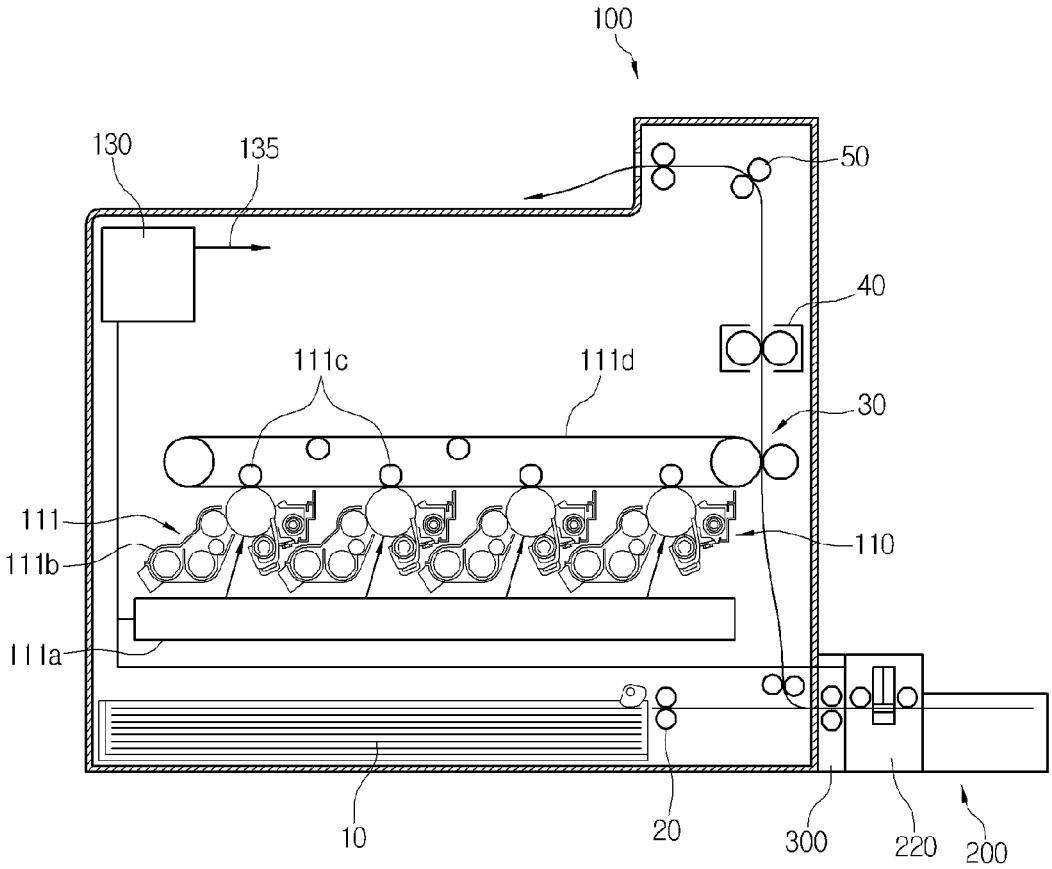
FIG. 5 illustrates an image forming system according to an exemplary embodiment of the present general inventive concept.
Figure 6:
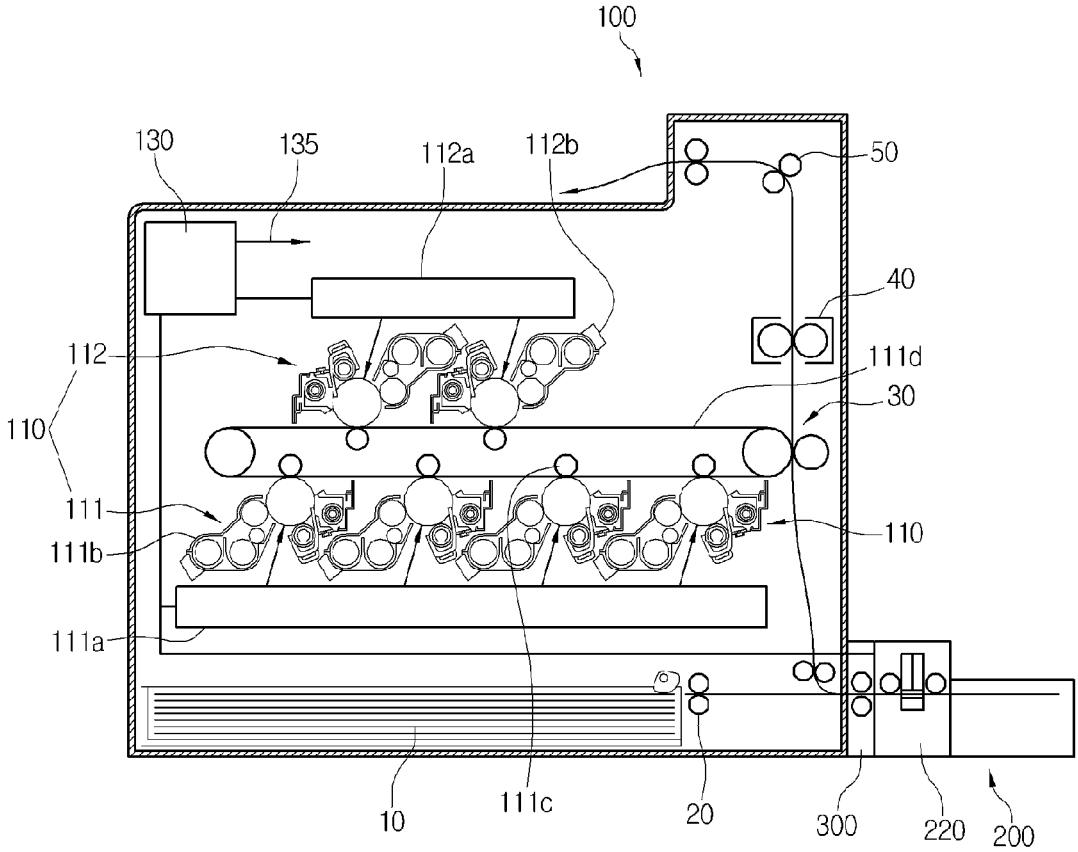
FIG. 6 illustrates an image forming system according to an exemplary embodiment of the present general inventive concept.

FIGS. 5 and 6 illustrate image forming systems according to additional exemplary embodiments of the present general inventive concept.

Each of the image forming systems illustrated in FIGS. 5 and 6 includes a first image forming system 100 having a first developing unit 110, and a second image forming system 200 having a second developing unit 220. The first image forming system 100 and the second image forming system 200 may be provided separately. For example, the first image forming system 100 may be a color laser printer using dry developers, namely yellow, magenta, cyan and black developers, and the second image forming system 200 may be an inkjet printer using color ink. Additionally, the second image forming system 200 may be contained as an option of the first image forming system 100, rather than being provided separately. The first and second developing units of FIGS. 5 and 6 can have similar structures to those illustrated in FIGS. 1 and 2. Main developing unit 111 may include exposure device 111*a* and a plurality of rotating bodies 111*b* similar to those described above. Subsidiary developing unit 112. illustrated in FIG. 6, may include exposure device 112*a* and a plurality of rollers 112*b* similar to the main developing unit 111. Toner may be transferred to belt 111*d* from main developing unit 111 and subsidiary developing unit 112, and may be conveyed to transferring unit 30 for transfer to a recording medium, as described above. Operations may be controlled by controller 130 through control signals 135.

The first image forming system 100 and the second image forming system 200 may be connected to an interface apparatus 300. The interface apparatus 300 may include a paper conveying path and a conveying roller to convey sheets of print paper. The image forming system illustrated in FIG. 5 may include a connection terminal (not illustrated) through which signals are able to be exchanged between the first image forming system 100 and the second image forming system 200.

The print controller 130 of the first image forming system 100 exchanges signals with the second image forming system 200 through the interface apparatus 300, and sets printing conditions such as the printing order or print colors.

The second image forming system 200 using a wet developer such as ink may have a resolution greater than that of the first image forming system 100 using the dry developers, and may express more precise colors as described above. Accordingly, if a user desires to print a high-resolution image, such as a photograph, the print controller 130 may control the second developing unit 220 to perform light color printing with a high resolution, and the first developing unit 110 to perform dark color printing so as to finish printing.

According to the exemplary embodiment of the present general inventive concept as illustrated in FIG. 6, a first developing unit 110 using dry developers may include a main developing unit 111 to use yellow, magenta, cyan and black developers, and a subsidiary developing unit 112 to use a light color developer, such as a light cyan developer, a light magenta developer, a light yellow developer, a light black developer, and a transparent developer. Accordingly, the first developing unit 110 employing an electrophotographic process may perform both dark color printing and light color printing, and may compensate for the difference in thickness of portions of an image using a transparent developer.

Additionally, a second developing unit 220 may use a metallic liquid developer, such as a gold liquid developer, silver liquid developer or bronze liquid developer, a conductive liquid developer, or a special liquid developer visible only in a specialized environment such as one using infrared rays or ultraviolet rays. In such case, it is possible to print unique color prints, such as a corporate identification (CI) with gold, silver or bronze, which are impossible to print using a general developer without such special developers, or to obtain prints using the special liquid developer which is able to be applied to a secure document to be identified only in a specialized environment.

Furthermore, the print controller 130 may set the printing order if necessary. In more detail, the print controller 130 may control the second developing unit 220 to perform special printing prior to general color printing of the first developing unit 110 in the same manner as illustrated in FIG. 5. Alternatively, the print controller 130 may set the printing order such that a sheet of paper printed may be sent back to the second image forming system 200 after printing has finished and that the second image forming system 200 may perform special printing onto the sheet of paper.

While the second image forming system 200 is mounted as an option of the first image forming system 100, as illustrated in FIGS. 5 and 6, this is not intended as a limitation thereto. Accordingly, the present general inventive concept is equally applicable to a situation in which the second image forming system 200 is mounted inside the first image forming system 100, according to the designs, for example, as illustrated in FIGS. 1 to 4.

According to the exemplary embodiments described above, a dry type color image forming apparatus employing an electrophotographic process may perform printing at high speed and with great durability, but has difficulty expressing various colors with a high resolution. Accordingly, if the dry type color image forming apparatus is equipped with an inkjet type developing unit, which is inexpensive and has a simple structure suitable for performing light color printing with greater accuracy rather than using dry developers, it is possible to print more varied color images with high quality.

Although a few exemplary embodiments of the present general inventive concept have been illustrated and described, it will be appreciated by those skilled in the art that changes may be made in these exemplary embodiments without departing from the principles and spirit of the general inventive concept, the scope of which is defined in the appended claims and their equivalents.

What is claimed is:

1. An image forming system comprising:

a first developing unit to form an image using a dry developer;

a second developing unit to form an image using a wet developer; and a drying unit located between the first developer and the second developer to dry the wet developer, wherein the dry developer used by the first developing unit comprises yellow, magenta, cyan and black developers, and the wet developer used by the second developing unit comprises a developer having a lighter color than the dry developer used by the first developing unit.

2. The image forming system of claim 1, wherein the second developing unit comprises an inkjet module detachably mounted in the image forming system.

3. The image forming system of claim 1, wherein the second developing unit is disposed below the first developing unit based on a direction in which a sheet of paper is conveyed.

4. The image forming system of claim 1, wherein the second developing unit uses at least one color developer among light cyan, light magenta, light black, light yellow, white and transparent developers.

5. The image forming system of claim 1, wherein the second developing unit uses at least one liquid developer among a metallic liquid developer, a conductive liquid developer and a liquid developer visible with infrared rays or ultraviolet rays.

6. The image forming system of claim 1, wherein the first developing unit further comprises a subsidiary developing unit to use color developers other than the yellow, magenta, cyan and black developers, and the second developing unit uses at least one liquid developer among a metallic liquid developer, a conductive liquid developer and a liquid developer visible with infrared rays or ultraviolet rays.

7. The image forming system of claim 1, further comprising:

a fixing unit to fix an image developed by the first developing unit, wherein the second developing unit is disposed below the fixing unit.

8. The image forming system of claim 1, wherein the first developing unit and the second developing unit are selectively operated.

9. An image forming system comprising:

a first printing apparatus using a dry developer;

a second printing apparatus configured in the form of a module detachably mounted in the image forming system, the second printing apparatus using a wet developer; and a drying unit located between the first printing apparatus and the second printing apparatus to dry the wet developer, wherein a first color developer used by the first printing apparatus is different in color from a second color developer used by the second printing apparatus.

10. The image forming system of claim 9, wherein the second color developer is lighter than the first color developer.

11. The image forming system of claim 10, wherein printing is performed using the second printing apparatus and then using the first printing apparatus.

12. An image forming system comprising:

a first image forming system comprising a first developing unit to form an image using a dry developer;

a second image forming system comprising a second developing unit to form an image using a wet developer, the second image forming system being detachably mounted in the first image forming system; and an interface apparatus to connect the first image forming system to the second image forming system, to enable a signal exchange therebetween, wherein the interface apparatus is one of a server and a personal computer (PC) which are connected to the first image forming system and the second image forming system, and the interface apparatus outputs a control command to print a normal image using the first image forming system after performing light color printing using the second image forming system.

13. The image forming system of claim 12, wherein the first image forming system is provided separately from the second image forming system, and is connected to the second image forming system so that a signal is exchanged therebetween through the interface apparatus.

14. The image forming system of claim 12, wherein the interface apparatus comprises a paper supply unit to convey sheets of paper according to a printing order.

15. The image forming system of claim 14, wherein the paper supply unit is provided integrally with one of the first image forming system and the second image forming system.

16. The image forming system of claim 14, wherein the paper supply unit is provided separately and connects the first image forming system to the second image forming system.

17. An image forming system, comprising:

a dry developing unit to form a first image on a recording medium at a first resolution; and a wet developing unit to form a second image on the recording medium at a second resolution different from the first resolution, wherein the dry developing unit and the wet developing unit are disposed within a housing.

18. The image forming system of claim 17, wherein the recording medium is fed to the dry developing unit before being fed to the wet developing unit.

19. The image forming system of claim 17, wherein the recording medium is fed to the wet developing unit before being fed to the dry developing unit.

20. The image forming system of claim 17, wherein the second image is formed at least one of adjacent to, at an edge of, overlapping, partially overlapping, around, next to, or at a boundary of the first image.

21. The image forming system of claim 17, wherein the first image and the second image are formed on different sides of the recording medium.

22. The image forming system of claim 17, wherein the dry developing unit and the wet developing unit are selectively operated such that only one of the dry developing unit and the wet developing unit form an image on the recording medium.

23. The image forming system of claim 17, wherein the dry developing unit includes at least one of yellow, cyan, magenta, black, light cyan, light magenta, light black, light yellow, white, and a transparent developer.

24. The image forming system of claim 17, wherein the wet developing unit includes at least one of a metallic liquid developer, a conductive liquid developer, a liquid developer visible with infrared or ultraviolet light, light cyan, light magenta, light black, light yellow, white, and a transparent developer.

25. A method of forming an image in an image forming apparatus having a wet image forming unit and a dry image forming unit disposed in a housing, the method comprising:

feeding a recording medium to at least one of the wet image forming unit and the dry image forming unit to form at least one of a first image and a second image on the recording medium, respectively, wherein the second image at least partially overlaps the first image, and the wet developing unit performs at least one of definition adjustment, image edge processing, gamut mapping, half tone processing, forming a smooth tone, and forming a glossy image on the second image formed by the dry image forming unit.

26. The method of claim 25, wherein the first image is formed before the second image.

27. The method of claim 25, wherein the second image is formed before the first image.

28. The method of claim 25, wherein the first image and the second image are formed on different sides of the recording medium.

29. The method of claim 25, wherein the first image and the second image are formed at different resolutions.

* * * * *